US009853383B2

(12) United States Patent
Hricik

(10) Patent No.: US 9,853,383 B2
(45) Date of Patent: Dec. 26, 2017

(54) CONDUCTIVE POLYMER CONTACTS FOR SURFACE MOUNT TECHNOLOGY CONNECTORS

(71) Applicant: General Electric Company, Schenectady, NY (US)

(72) Inventor: Jason Paul Hricik, Phoenix, AZ (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/851,947

(22) Filed: Sep. 11, 2015

(65) Prior Publication Data

US 2017/0077633 A1 Mar. 16, 2017

(51) Int. Cl.

| | |
|---|---|
| ***H01R 4/58*** | (2006.01) |
| ***H01R 13/03*** | (2006.01) |
| ***H01R 12/71*** | (2011.01) |
| ***H01R 13/24*** | (2006.01) |

(52) U.S. Cl.

CPC ..... *H01R 13/03* (2013.01); *H01R 12/714* (2013.01); *H01R 13/2414* (2013.01)

(58) Field of Classification Search

CPC ..... H01R 12/52; H01R 13/2414
USPC ..... 439/91, 86
See application file for complete search history.

(56) References Cited

U.S. PATENT DOCUMENTS 3,680,037 A * 7/1972 Nellis ..... H01R 12/714 174/262
3,880,486 A * 4/1975 Avakian ..... H01R 9/091 174/262
3,971,610 A * 7/1976 Buchoff ..... G04C 3/005 174/254
4,027,936 A * 6/1977 Nemoto ..... H01R 13/2414 439/591
4,664,309 A * 5/1987 Allen ..... B23K 3/06 228/175
5,374,196 A * 12/1994 Horine ..... H01R 12/52 174/264
5,738,530 A * 4/1998 Schreiber ..... H01R 13/2414 439/66
5,810,607 A * 9/1998 Shih ..... H01R 13/2414 439/66
5,971,253 A * 10/1999 Gilleo ..... H01L 23/49827 228/104
6,078,500 A * 6/2000 Beaman ..... H01L 23/3107 165/185
6,280,207 B1 * 8/2001 Sakata ..... H01R 13/2414 439/591
6,864,575 B2 * 3/2005 Hedler ..... H01L 24/11 257/734
7,097,471 B2 * 8/2006 Narui ..... H01R 43/007 439/66
2016/0036142 A1 * 2/2016 Mason ..... H01R 12/777 439/66

* cited by examiner

*Primary Examiner* — Phuong Dinh
(74) *Attorney, Agent, or Firm* — Boyle Fredrickson, S.C.

(57) ABSTRACT

In the present invention, a surface mount technology (SMT) connector for a printed circuit board (PCB) or a flexible printed circuit (FPC) includes a body formed of a non-conductive material, a connection member disposed on the body and adapted to engage the body with a mating surface and at least one terminal disposed on the body, the at least one terminal formed from a conductive polymer.

12 Claims, 3 Drawing Sheets

CONDUCTIVE POLYMER CONTACTS FOR SURFACE MOUNT TECHNOLOGY CONNECTORS

BACKGROUND OF INVENTION

The invention provides a robust connection interface for surface mount technology (SMT) contacts used in the manufacture of electronic devices that have high area densities or high wear environments, and that accommodates contact surface irregularities without significant wear to the either contact surface.

In SMT contacts, connector components are applied directly to the surface of a circuit board. The components are secured at specified locations on the circuit board by solder pads that are placed on the circuit board in a suitable process, such as by printing the pads on the board forming a printed circuit board (PCB). The solder pads are then heated and the various components are placed onto the solder pads to be secured to the PCB by the cooling solder pads bonding the components to the PCB.

In the manufacture of the PCBs, to provide electrical connection to external or peripheral components various SMT style connectors are used, including but not limited to: Land Grid Arrays (LGAs), Ball Grid Arrays (BGAs), Pin Grid Arrays (PGAs), Flexible Flat Cable (FPC) connectors, and Pogo™ contacts. These connectors or components are usually soldered to one side of the circuit board and require a mating connector affixed to the external component.

In one prior art embodiment, as illustrated in FIG. 1, the component secured to the PCB 10 is a connector 18 used to interconnect the PCB 10 with another PCB or with a cable/flex circuit 20 having a complementary connector 26 thereon that is operably connected to another part of the device. These connectors 18,26 each include a body with complementary connecting structures thereon, as well as tabs 14 utilized to connect the connector body 18,26 to the associated PCB 10,20 using the solder pads 12. The connecting structures 16,24 can take various forms, such as POGO pins and rigid metal contacts, or the tubular mating sockets configured to receive the pins or rigid metal contacts, which in FIG. 1—are tensioned, U-channels or sockets of metal, 16 and rigid, U-shaped tabs, 24. The pins, contacts, e.g., a bed-of-nails contact array, or other connectors 24 are pressed into engagement with a suitably formed mating connector, such that an electric connection can be formed between the pin or contact 24 and socket 16 of the mating connector. To facilitate the connection between the contact 24 and the socket 16, the contact and/or the socket, of whatever form, often include a electrical connection-enhancing surface coating on the exterior of the contact(s) 24 and/or socket(s) 16.

One significant drawback with regard to these connectors is that the materials utilized to form the contacts are normally formed of a rigid material in order to facilitate the conductivity or electrical connections between the contacts and the other PCB or device with which the contacts are engaged. As a result, the contacts are formed with various surface irregularities that, when subjected to repeated connect/disconnect cycles, can damage the materials forming the contacts themselves or the contact that is pressed into engagement with the contact containing the surface irregularity. Also, if an excessive or shear force is inadvertently exerted to engage the connectors with one another, it is possible to permanently deform and/or damage the shape of the contacts and/or the coatings on the contacts, thereby degrading the connection between the contacts and other contacts that may be subsequently engaged with the damaged contacts.

Further, even without significant damage to the structure of either contact surface, surface irregularities can cause the interface to be unstable or not possible without exerting additional, potentially destructive force to the contacts already engaged.

Additionally, as with all surface mount devices employing rigid electrical traces, bending or flexing due to thermal expansion, pressure or vibration can cause solder and metal trace materials to fracture, irreparably damaging the contact; which in the case of many connection styles will require full replacement of the connector.

Accordingly, it is desirable to develop an electrical contact structure for use in SMT applications and in the devices constructed thereby that can successfully accommodate structural irregularities on other contact structures to minimize potential damage to the various contact structures and to maximize the electrical connections formed between the contacts.

BRIEF DESCRIPTION OF THE INVENTION

There is a need or desire for an improved contact structure for use in SMT applications where repeated connect/disconnect cycles or contact surface irregularities cause increased wear on the contact surface or connector contacts. The above-mentioned drawbacks and needs are addressed by the invention embodiments in the following descriptions.

According to one exemplary aspect of the invention, an improved contact structure for use in SMT applications is formed from a z-axis conductive polymer. The conductive polymer, forming the contacts of a connector, can conduct an electric signal from and function as the connection to an exposed circuit contact/connector. The polymer can self-heal when physically deformed by engagement with another circuit contact/connector. Thus, the conductive polymer contact can accommodate repeated engagement with rigid circuit contacts without any permanent deformation of either contact surface, to which PGA, FFC and Pogo™ (e.g. spring tension) connectors are susceptible.

According to another aspect of an exemplary embodiment of the invention, the conductive polymer is capable of engaging a contact having a contact-enhancing surface coating thereon without damaging the coating, due to the malleable nature of the polymer. The polymer does not create significant friction when engaged with a rigid contact, such that the contact coating is not damaged during connection or upon disengagement of the contact from the polymer contact.

According to yet another exemplary embodiment of the invention, the malleable conductive polymer is able to conform around surface irregularities of rigid and flexible circuit contacts. The polymer is thus able to form a better connection at lower overall contact pressures than are required by LGA or FFC or other prior art SMT connectors.

Another exemplary embodiment of the invention, the conductive polymer exhibits a degree of surface tension with the intended contact surface. The connector can therefore maintain better contact in environments with mechanical vibration or warping due to the attractive force of the surface tension unlike BGA or other various prior art soldered SMT connections.

Another exemplary embodiment of the invention, the polymer acts to reduce empty space between the contact surfaces. The action of deformation due to the surface tension of the polymer effectively self-seals the contact surfaces from the environment. Thus, the conductive polymer helps to prevent contamination of the contacts.

According to yet another exemplary embodiment of the invention, the aforementioned conductive polymer connectors do not require complex manufacturing technology to produce. The connector body can be easily manufactured using any process that can produce channels in a material (e.g. additive, multi-part, or chemically-etched construction, etc.). The channels are then filled (e.g. through injection, deposition or vacuum-drawn fill methods, among others) with the conductive polymer to form the contact surface features described herein.

According to still another aspect of one exemplary embodiment of the invention, complex branching and connective patterns can be created through the use of axis-limited conductive polymers (e.g. z-axis conductive polymer) in single or multiple layers; thus allowing for high contact densities to break-out into different connector styles.

According to still a further aspect of one exemplary embodiment of the invention, a surface mount technology (SMT) connector for a printed circuit board (PCB) includes a body formed of a non-conductive material a connection member disposed on the body and adapted to engage the body with a mating surface and at least one terminal disposed on the body formed from a conductive polymer.

According to still another aspect of one exemplary embodiment of the invention, a surface mount technology (SMT) connector set for joining a printed circuit board (PCB) and/or a flexible printed circuit (FPC) to one another includes a first connector including a set of conductive polymer contacts thereon and a second connector including a set of electrical contacts thereon, wherein the set of conductive polymer contacts is alignable with the set of electrical contacts to provide an electrical connection therebetween.

According to still a further aspect of one exemplary embodiment of the invention, a method for forming a surface mount technology (SMT) connector for a printed circuit board (PCB) or a flexible printed circuit (FPC includes the steps of forming a connector body including a number of channels extending completely through the connector body and filling the channels with an amount of a conductive polymer to form a conductive polymer contact in the connector body.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The drawings illustrate the best mode presently contemplated of carrying out the disclosure. In the drawings

DETAILED DESCRIPTION OF THE DRAWINGS

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
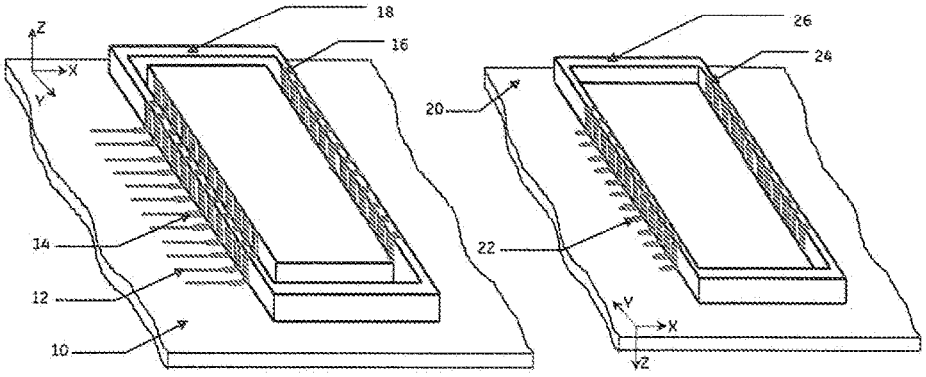
FIG. 1 PRIOR ART
FIG. 1 is an isometric view of a prior art surface mount technology flexible printed circuit (FPC) board-to-board female and male connector.
Figure 2:
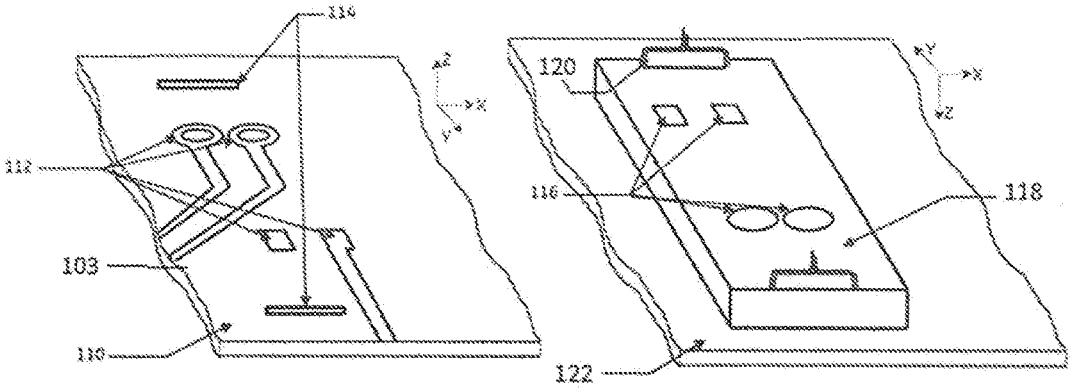
FIG. 2 is an isometric view of circuit board traces (left) and a matching connector according to one exemplary embodiment of the invention.

Further, the foregoing summary, as well as the following detailed description of certain embodiments, will be better understood when read in conjunction with the appended drawings. It should be understood that the various embodiments are not limited to the arrangements and instrumentality shown in the drawings Looking at FIGS. 2, and 3 one exemplary embodiment of a connector 118 of the invention is illustrated in a connector set 101 including a female connector 103. In the exemplary embodiment the connector 118 is formed as the male connector 118 mounted on flexible printed circuit (FPC) 122 and includes a body 102 formed in any desired or necessary configuration of a non-conductive and optionally flexible material. The body 102 is secured to the FPC in any suitable manner and includes a connection member providing pressure between mating surfaces, such as connector tabs 120 affixed thereto to guide and fix the connector 118 to a separate rigid printed circuit board (PCB) 110 using sockets 114 on the PCB 110. The body 102 of the connector 118 also includes contacts 116 formed of a conductive, isotropic or non-isotropic polymer, or combinations of layers thereof, disposed within channels, apertures or other openings 111 formed in the body 102 of the connector 118. The channels 111 extend completely through the body 102 such that the conductive polymer contacts 116 positioned therein extend the length of the channel 111 with a protrusion 113 on each end of the contact 116 that extend outwardly from each end of the channel 111. The protrusions 113 opposite the FPC 122 each contacts a trace pad 112 on the female connector 103 on the printed circuit board 110. In this manner, the contacts 116, via the protrusions 113, each make electrical contact between traces, wires or other electrical conductors (not shown) disposed in the FPC 122 and the traces 112 to facilitate an electrical connection between the FPC 122 the PCB 110 and can be, positioned in any way to afford contact with desired surfaces on the printed circuit board 110. Further, the size of the protrusions 113 can be selected as desired in order to facilitate the electrical contact of the contacts 116 with the various traces 112 on the FPC 122 and the PCB 110. In one exemplary embodiment, the protrusions 113 can extend outwardly from the channels 111 as shown in FIG. 1 to contact the traces 112, or can be positioned flush with the surface of the body 102, such as shown in FIG. 1 to contact the traces on the FPC 122. In the embodiment where the protrusions 113 extend outwardly form the channel 111, the properties of the polymer forming the contact 116 enable the protrusion 113 to be compressed upon contact with the trace 112 to create the electrical connection between the contact 116 and the trace 112, while also returning to its original configuration upon removal of the compressive force on the protrusion 113. Further, the surface tension of the polymer forming the contact 116 can operate to assist the protrusion 113 to contact the adjacent trace and form the required electrical connection.

Figure 3:
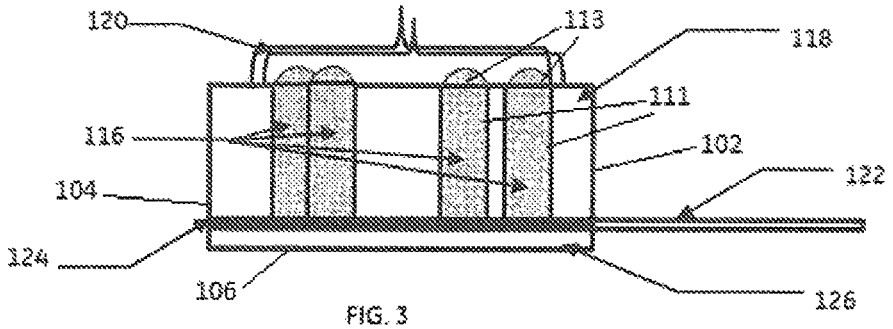
FIG. 3 is a cross-sectional view along line 3-3 of FIG. 2.

FIG. 3 illustrates an exemplary embodiment of the connector 118 in which the flexible printed circuit board 122 is clamped between two halves 104,106 of the connector body 102. Connector body part half 104 clamps in a suitable manner or is otherwise engaged onto body half 106, such as using an adhesive or mechanical fastener, from the other side of the FPC 122 to retain the end of the FPC 122 therebetween. A thin, compressible, non-isotropic layer of conductive polymer, direct interface, or metal contacts 124 is positioned between the halves 104,106 and contacts the flexible printed circuit traces positioned between halves 104, 106 to electrically connect the FPC traces with the proper channels 116.

Figure 4:
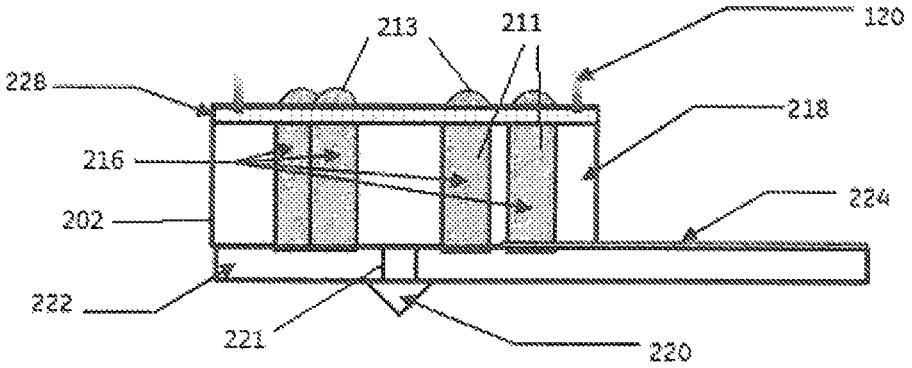
FIG. 4 is a cross-sectional view of a connector (gender neutral) in a form that interfaces with a rigid Printed Circuit Board (PCB) according to one exemplary embodiment of the invention.
Figure 5:
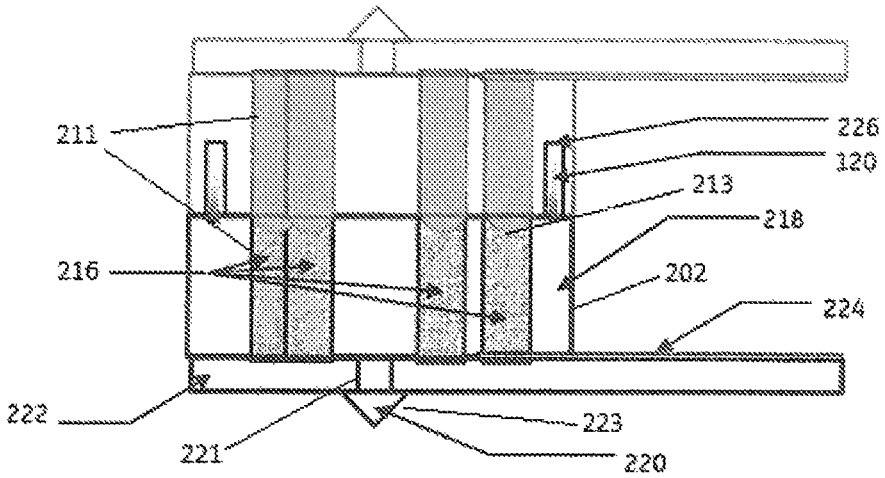
FIG. 5 is a cross-sectional view of a mated pair of gender neutral connectors illustrated in FIG. 4.

FIGS. 4 and 5 illustrate another exemplary embodiment of a connector 218 employing conductive polymer contacts 216 formed of the conductive polymer disposed within channels 211 formed in the body 202. In this construction, the connector 218 makes direct contact with traces 224 on a rigid printed circuit board 222. The connector 218 is held onto the PCB 222 by a suitable fastener, such as a mechanical fastener 220 including, but not limited to a clip or screw that is directly engaged with a bore 221 in the PCB 222, to provide enough pressure to engage and ensure direct contact between the conductive polymer disposed within the contacts 216 and the traces 224. This exemplary embodiment illustrates a "gender neutral" embodiment of the connector 218 that makes use of a compressible, non-conductive polymer surface 228 located on the connector body 202 opposite the PCB 222 disposed around the protrusions 213 of the polymer contacts 216 after exiting the body 202 of the rigid connector 218. In FIG. 5, the interface between two gender-neutral connectors 218 is illustrated where the connectors 218 are held together through a double-sided clipping mechanism 223 using mechanical fasteners 220 to hold the connectors 218 on the PCBs 210 as well as includes tabs 120 on one connector 218 that are insertable within and engageable with slots 226 formed in the opposite connector 218.

In the illustrated exemplary embodiments, the conductive polymer is positioned in the circuit channel 111, 211 to form the terminal. While any suitable polymer can be utilized in forming the polymer, certain exemplary polymers for use as the polymer component of the conductive polymer include, but are not limited, to either an isotropic or non-isotropic loaded polymer, and combinations and layers thereof, as well as z-axis polymers. The particular polymer used can be any suitable elastomer, including but not limited to rubbers and thermoplastic elastomers with a range of varying viscosity, including a polydimethylsiloxane or equivalent low modulus silicone based polymer that is able to reflow back into shape after deformation.

Further, in order to provide the conductivity required for the formation of the terminal or contact 116,216 using the conductive polymer, the polymer component includes an amount of conductive particles (not shown) dispersed throughout the polymer component, and in the exemplary embodiment uniformly throughout the polymer component. The conductive particles can be selected as desired any suitable electrically conductive particle, such as from metal or other conductive material particle, but in an exemplary embodiment can be selected from the group consisting of copper, gold, silver, palladium, platinum, and alloys thereof. Further, the size of the particles can be 3 to 500 microns with optionally an electrically conductive sphere, flake or amorphous form or shape and can be present within the polymer component in an amount ranging from about 1% to about 99% w/w of the conductive polymer.

In addition, in exemplary embodiments where conductivity through the contact 116 and/or connector layer in only one direction is required, an electrically isolative polymer, such as Sil-194 can be used. In cases where a particular layer is required to conduct isotropically, such as a polydimethylsiloxane or equivalent low modulus silicone based polymer, can used.

Figure 6:
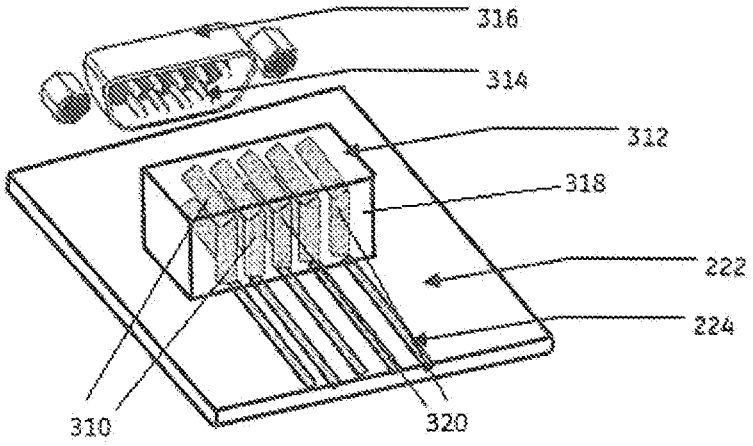
FIG. 6 is an isometric view of another exemplary embodiment of the invention.
Figure 7:
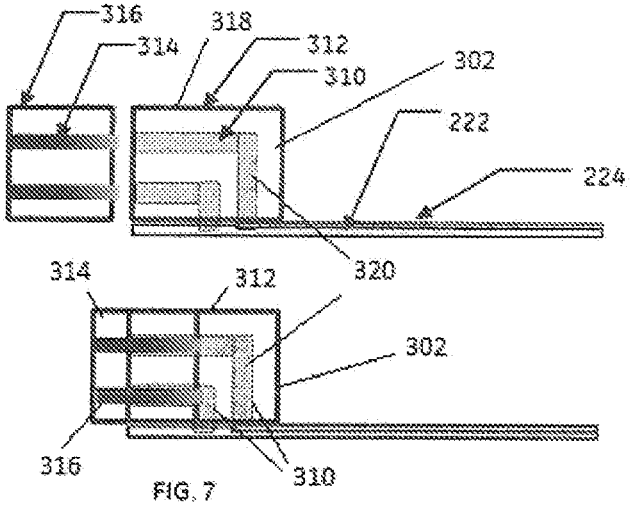
FIG. 7 is a cross-sectional view of the embodiment in FIG. 6 showing the unmated and mated contact with a standard serial connector style.

Looking now at FIGS. 6 and 7 another exemplary embodiment of the connector 312 is illustrated. In the connector 312, as well as optionally in the other embodiments for the connectors 118 and 218, channels 310 are formed through the solid connector body 302 through various methods of manufacture, including, but not limited to, injection molded techniques, additive deposition, or subtractive etching. The connector body 302 is held and/or secured to the PCB 222 by various mechanisms, including but not limited to adhesives or mechanical fasteners, such as those illustrated in FIGS. 3 and 4 above, in order to electrically connect the conductive polymer contacts 320 with the traces 224 on the PCB 222 using various methods, similar to FIGS. 3 and 4.

The connector 312 is engaged with a plug 316 including a number of rigid, conductive pins 314 disposed within housing 318 for the plug 316 and connected to wires or other suitable conductive members (not shown). To engage the plug 316 with the connector 312, the pins 314 are aligned with each of the channels 310 containing the conductive polymer contacts 320 and the pins 314 are forced or urges into the channels 310 to contact, deform and/or pierce the conductive polymer contact 320 within the channels 310, thus electrically connecting the pins 314 to the contacts 320. When the pins 314 are withdrawn from the channels 310, due to the flexible and resilient nature of the polymer, the polymer contacts 320 self-heal and return to their original undeformed configuration within the channels 310 until the pins 314 are reinserted into the channels 310.

To fill the channels 111, 211 or 310 in any of the illustrated exemplary embodiments with the conductive polymer to form the contact 116 within the channel 111, 211, 310, injection, vacuum drawing, deposition, or any other suitable method can be used so long as the polymer completely fills the channel 111, 211, 310, and in the illustrated exemplary embodiments of FIGS. 2-5 is able to form a dome or protrusion 113,213 at the surface interface due to surface tension. Further, in the exemplary embodiment of FIGS. 6 and 7, the polymer can alternatively fill less than each of the entire channels 310 in order to accommodate the insertion of the pins 314 into the channels 310, as desired.

Additionally, with regard to each of the exemplary embodiments of FIGS. 2-7, the flexible and resilient properties of the polymer forming the contacts 320 prevents any surface irregularities on the pins 314 from damaging the contacts 320, and prevents the contacts 320 from damaging any coating applied to the exterior of the pins 314. Further, in this and the other exemplary embodiments, the surface tension attributes of the polymer forming the contacts 320 promote the self-healing of the polymer contacts 320, maintains a relatively constant insertion and disengagement force between the pins 314 and the contacts 320, prevents contamination of the contacts, maintains better contact in environments with mechanical vibration or warping due to the attractive force of the surface tension, and provides better connection at lower overall contact pressures.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A surface mount technology (SMT) connector for a printed circuit board (PCB) or a flexible printed circuit (FPC), the connector comprising:

a body formed of a non-conductive material;

a connection member disposed on the body and adapted to engage the body with a mating surface; and at least one terminal disposed on the body, the at least one terminal formed from a conductive polymer, wherein the connection member comprises:

a first half of the body;

a second half of the body; and a fastener secured between the first half and the second half and adapted to secure a PCB or FPC between the first half and the second half.

2. The connector of claim 1 wherein the conductive polymer is selected from the group consisting of: an isotropic conductive polymer, a non-isotropic conductive polymer and combinations thereof.

3. The connector of claim 2 wherein the conductive polymer comprises:

an electrically isolative polymer component; and an amount of conductive particles dispersed within the polymer component.

4. The connector of claim 3 wherein the conductive polymer is a z-axis conductive polymer.

5. The connector of claim 3 wherein the conductive particles are selected from the group consisting of copper, gold, silver, nickel, palladium, platinum, and alloys thereof.

6. The connector of claim 3 wherein the conductive particles have a size in the range of 3 microns to 500 microns.

7. The connector of claim 3 wherein the conductive particles are either sphere, flake or amorphous in form.

8. The connector of claim 3 wherein the conductive particles are present in an amount of from 1% to 99% w/w of the conductive polymer.

9. The connector of claim 1 wherein the connection member comprises a mechanical fastener secured to the body and adapted to be inserted through a PCB or FPC.

10. A surface mount technology (SMT) connector set for joining a printed circuit board (PCB) and/or a flexible printed circuit (FPC) to one another, the connector set comprising:

a first connector including a set of conductive polymer contacts thereon; and a second connector including a set of electrical contacts thereon, wherein the set of conductive polymer contacts is alignable with the set of electrical contacts to provide an electrical connection therebetween, wherein the set of electrical contacts are pins insertable into the set of conductive polymer contacts.

11. A surface mount technology (SMT) connector set for joining a printed circuit board (PCB) and/or a flexible printed circuit (FPC) to one another, the connector set comprising:

a first connector including a set of conductive polymer contacts thereon; and a second connector including a set of electrical contacts thereon, wherein the set of conductive polymer contacts is alignable with the set of electrical contacts to provide an electrical connection therebetween, wherein the set of electrical contacts is a set of conductive polymer contacts.

12. The connector set of claim 11 wherein the set of conductive polymer contacts are pads.

* * * * *